US006055917A

United States Patent [19]

Shortnacy

[11] Patent Number: 6,055,917

[45] Date of Patent: May 2, 2000

[54] ANIMAL CARCASS INCINERATION PROCESS

[76] Inventor: Brent M. Shortnacy, 114 Wilson St., Adairsville, Ga. 30103

[21] Appl. No.: 09/135,324

[22] Filed: Aug. 17, 1998

[51] Int. Cl.[7] ..... F23G 1/00; F23G 5/00; F23B 7/00

[52] U.S. Cl. ..... 110/346; 110/342; 110/101 R; 110/219; 110/222; 110/227; 110/233; 241/92

[58] Field of Search ..... 110/346, 345, 110/341, 210, 211, 219, 222, 224, 227, 228, 233, 235, 255, 257, 259, 101 R, 106, 110; 241/92

[56] References Cited

U.S. PATENT DOCUMENTS

| | | | |
|---|---|---|---|
| 750,457 | 1/1904 | Haycock et al. | 110/224 X |
| 1,096,854 | 5/1914 | Morley | 110/222 |
| 1,099,392 | 6/1914 | Woollacott et al. | 110/222 |
| 3,109,392 | 11/1963 | Riepl et al. | 110/222 |
| 3,565,350 | 2/1971 | Combs et al. | 241/43 |
| 3,622,086 | 11/1971 | Yamagishi | 24/43 |
| 3,695,520 | 10/1972 | Mauro | 241/43 |
| 3,716,197 | 2/1973 | Craig et al. | 241/43 |
| 4,029,262 | 6/1977 | Lazich et al. | 241/43 |
| 4,089,277 | 5/1978 | Paul | 110/204 |
| 4,179,263 | 12/1979 | Jung et al. | 110/346 X |
| 4,504,222 | 3/1985 | Christian | 110/110 X |
| 5,076,504 | 12/1991 | Young | 241/92 |
| 5,231,936 | 8/1993 | Kikuchi et al. | 110/224 |
| 5,598,979 | 2/1997 | Rowley, Jr. | 241/5 |

FOREIGN PATENT DOCUMENTS

| | | | |
|---|---|---|---|
| 57-16713 | 1/1982 | Japan | 110/222 |
| 2 313 901 | 12/1997 | United Kingdom . | |

*Primary Examiner*—Ira S. Lazarus
*Assistant Examiner*—Ljiljana V. Ciric
*Attorney, Agent, or Firm*—Henderson & Sturm LLP

[57] ABSTRACT

An animal carcass incineration process comprising the steps of: providing a large hopper with a large spring loaded trap door at the top, a series of stationary and rotating blades in the center and a second set of spring loaded doors below. The hopper features a double walled construction which serves to keep the blade drive gears and rollers away from the carcasses as they are being processed through the rotating blades. The carcass hopper blade assembly incorporates a slide out drawer allowing the entire unit to slide out for maintenance and cleaning. A ramp is provided that leads to the top of the hopper to allow a rendering truck to dump carcasses directly into the hopper. A large pipe is provided with an opening beneath the bottom of the hopper and includes a hydraulically driven auger for forcing the shredded carcasses upward along the pipe. A very hot exhaust gas pipe is vented into the auger pipe and is used for removing moisture from the carcass to be burned. Once the carcass remains have reached the top of the auger pipe they are dumped into an incinerator unit that is driven by a hot blower induced oil fire. Heavy smoke and ash from this first stage burning then enters a secondary incineration area that incorporates burning via natural gas. The remaining exhaust gases enter a multi-level filter to catch remaining particles.

1 Claim, 2 Drawing Sheets

ANIMAL CARCASS INCINERATION PROCESS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of incineration systems, and more particularly to an animal carcass incineration system.

2. Description of Related Art

As can be seen by reference to the following U.S. Pat. Nos. 3,565,350; 3,622,086; 3,695,520; 3,716,197; 4,029,262; and 5,598,979, the prior art is replete with myriad and diverse incinerators.

While all of the aforementioned prior art constructions are more than adequate for the basic purpose and function for which they have been specifically designed, they are uniformly deficient with respect to their failure to provide a simple, efficient, and practical animal carcass incineration system.

As a consequence of the foregoing situation, there has existed a longstanding need for a new and improved animal carcass incineration system and the provision of such a construction is a stated objective of the present invention.

BRIEF SUMMARY OF THE INVENTION

Briefly stated, the present invention provides an animal carcass incineration process comprising the steps of: providing a large hopper with a large spring loaded trap door at the top, a series of stationary and rotating blades in the center and a second set of spring loaded doors below. The hopper features a double walled construction which serves to keep the blade drive gears and rollers away from the carcasses as they are being processed through the rotating blades. The carcass hopper blade assembly incorporates a slide out drawer allowing the entire unit to slide out for maintenance and cleaning. A ramp is provided that leads to the top of the hopper to allow a rendering truck to dump carcasses directly into the hopper. A large pipe is provided with an opening beneath the bottom of the hopper and includes a hydraulically driven auger for forcing the shredded carcasses upward along the pipe. A very hot exhaust gas pipe is vented into the auger pipe and is used for removing moisture from the carcass to be burned. Once the carcass remains have reached the top of the auger pipe they are dumped into an incinerator unit that is driven by a hot blower induced oil fire. Heavy smoke and ash from this first stage burning then enters a secondary incineration area that incorporates burning via natural gas. The remaining exhaust gases enter a multi-level filter to catch remaining particles.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1A:
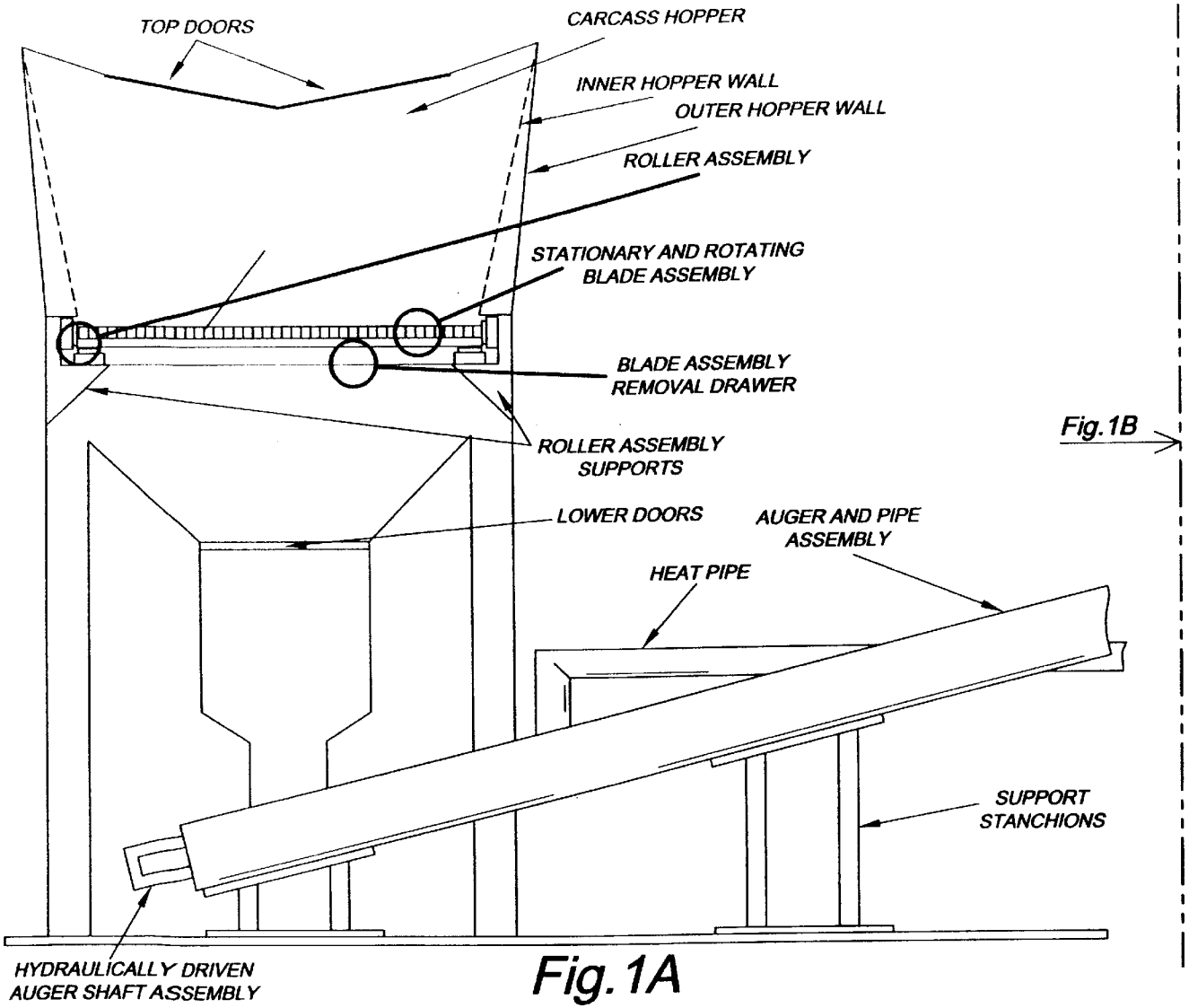
FIG. 1 is a schematic view of the animal carcass incineration system of the present invention.
Figure 1B:
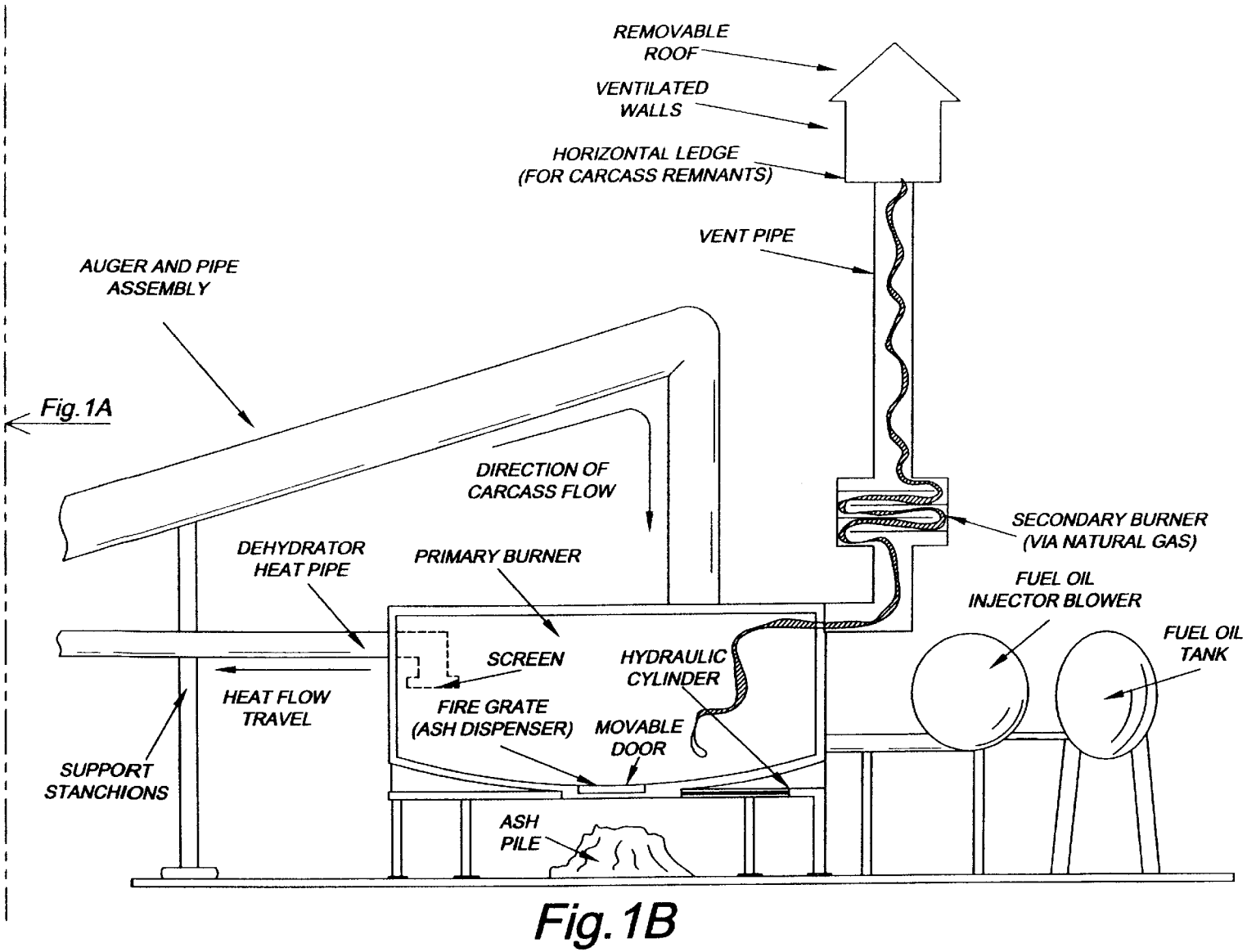

As can be seen by reference to FIG. 1 of the drawings, the present invention consists of several components that working in conjunction with each other allow one to dispose of any number of large or small animal carcasses in one continuous automated process that results in nothing more than ash after the carcass has completed the cycle. The first step of the process involves a large carcass hopper with spring loaded trap doors at the top, a series of stationary and rotating blades in the center, and a second set of spring loaded doors below. The hopper features a double wall construction which serves to keep the blade drive gears and rollers away from the carcasses as they are being processed through the rotating blades. The carcass hopper blade assembly is incorporated into a slide out drawer, allowing the entire unit to be slid out for maintenance and cleaning. A ramp leads to the top of the hopper, allowing a rendering truck to dump carcasses directly into the hopper. A carcass, after being shredded and falling through to the bottom of the hopper, travels up a large tube or pipe via means of a hydraulically driven auger. Very hot exhaust gas from the primary incinerator is pumped into the base of the auger pipe, effectively dehydrating the shredded carcass pieces before they reach the incinerator, resulting in faster more efficient incineration. After traveling up the length of the pipe or tube, and with most moisture removed, the pieces fall into the primary incinerator burner where a very hot blower induced oil fire is burning. The first stage of the incineration process occurs here. Heavy smoke and ash from this stage travels up the flue and enters the secondary incineration area which is burning via natural gas. After traveling through this stage, the remaining gases travel up to a multi-level filtering area that catches remaining particles of any size. The final, exiting gas is virtually smoke and ash free. The main incinerator burner features a hydraulically controlled movable door below the ash grate that when opened, allows bulk ash from the burner box to drop out to the area below, where it can be disposed of or collected for other uses such as fertilizer additives, etc., as desired. The secondary burner and filter areas also feature means of removing any collected residues. Fire bricks line both incinerator areas. All components would be easily accessible for maintenance.

In use, an animal carcass requiring disposal is placed into the carcass hopper where it is reduced to very small pieces via the rotating and stationary blades. After shredding, the components travel up the pipe to the incinerator via the hydraulically operated auger. At the same time, unwanted moisture is removed via the hot primary incinerator exhaust gas which is being pumped into the base of the auger pipe. After dehydration, the remaining components fall into the primary incinerator where they are reduced to ash. Any remaining heavy by-products are further incinerated in the secondary burner, and then remaining gases and smoke particles travel up into the exhaust filter where final particles are stopped and the remaining gas exists. Use of the present invention provides a very practical and cost effective method of dealing with the problem of how to dispose of animal carcasses which would otherwise pollute the surrounding environment.

The present invention is a large scale mechanized device that allows one to shred, dehydrate, and incinerate animal carcasses effectively doing away with problems associated with placing these carcasses in landfills, etc.

EPA regulations prohibit disposing of animal carcasses in covered pits due to possible groundwater pollution. The present invention provides a commercial machine to effectively and thoroughly handle animal carcasses.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An animal carcass incineration process, consisting of:

depositing animal carcasses into a carcass hopper;

shredding the carcasses in the carcass hopper;

discharging the shredded carcasses into a closed heated tube;

simultaneously dehydrating the shredded carcasses within the heated tube and transporting the shredded carcasses to a primary incinerator;

incinerating the shredded carcasses in the primary incinerator to yield an ash component and a by-product component;

discharging the ash component from the primary incinerator and transporting the by-product component to a secondary incinerator;

incinerating the by-product component in the secondary incinerator; and filtering a portion of the by-product component vented from the secondary incinerator;

wherein the shredding step is accomplished by a blade assembly disposed within the carcass hopper;

wherein the blade assembly is mounted on a removable drawer in the carcass hopper; and wherein the closed heated tube is heated by hot exhaust gas from the primary incinerator.

* * * * *